United States Patent [19]

Goedken et al.

[11] Patent Number: 4,887,873

[45] Date of Patent: Dec. 19, 1989

[54] FILE SYSTEM WITH HANG RAIL

[75] Inventors: James Goedken, Muscatine; Clayton Schmidt, Wilton, both of Iowa

[73] Assignee: Hon Industries, Inc., Muscatine, Iowa

[21] Appl. No.: 275,693

[22] Filed: Nov. 23, 1988

Related U.S. Application Data

[63] Continuation of Ser. No. 108,785, Oct. 15, 1987, abandoned.

[51] Int. Cl.[4] ..... A47B 63/00

[52] U.S. Cl. ..... 312/184; 312/330.1

[58] Field of Search ..... 211/126; 248/220, 31, 248/224, 4; 312/183, 184, 330 R

[56] References Cited

U.S. PATENT DOCUMENTS

| | | | |
|---|---|---|---|
| 3,025,911 | 3/1962 | McLean | 211/208 |
| 3,266,496 | 8/1966 | West | 211/46 X |
| 3,417,872 | 12/1968 | Close | 211/208 |
| 3,540,786 | 11/1970 | Potter | 312/184 |
| 3,647,101 | 3/1972 | Hensch et al. . | |
| 3,944,080 | 3/1976 | Hansen | 312/184 |
| 4,030,610 | 6/1977 | Alexander . | |
| 4,262,816 | 4/1981 | Ilich | 211/46 X |
| 4,526,277 | 7/1985 | Snowden et al. | 211/46 |

FOREIGN PATENT DOCUMENTS

| | | | |
|---|---|---|---|
| 1074384 | 3/1980 | Canada | 312/184 |

*Primary Examiner*—Joseph Falk

*Attorney, Agent, or Firm*—Neuman, Williams, Anderson & Olson

[57] ABSTRACT

A file system is disclosed which includes a pair of attachable hang rails for suspending hanging files in a drawer. Each hang rail includes a horizontal bar, a vertical post and a connector segment. The front end of the horizontal bar includes a camming surface and a notch. The front end is inserted into a slot on the inside surface of a front wall of a drawer. The bottom edge of the slot provides vertical support for the horizontal bar. The camming surface acts with the bottom edge of the slot to cause the notch to straddle the top edge of the slot, thereby locking the horizontal bar in the slot and providing longitudinal and rotational stability. The vertical post is supported by a pair of bracing sleeves located on the back wall of a drawer which provide transverse and rotational stability. The vertical post rests on the bottom of the drawer to provide vertical support.

5 Claims, 3 Drawing Sheets

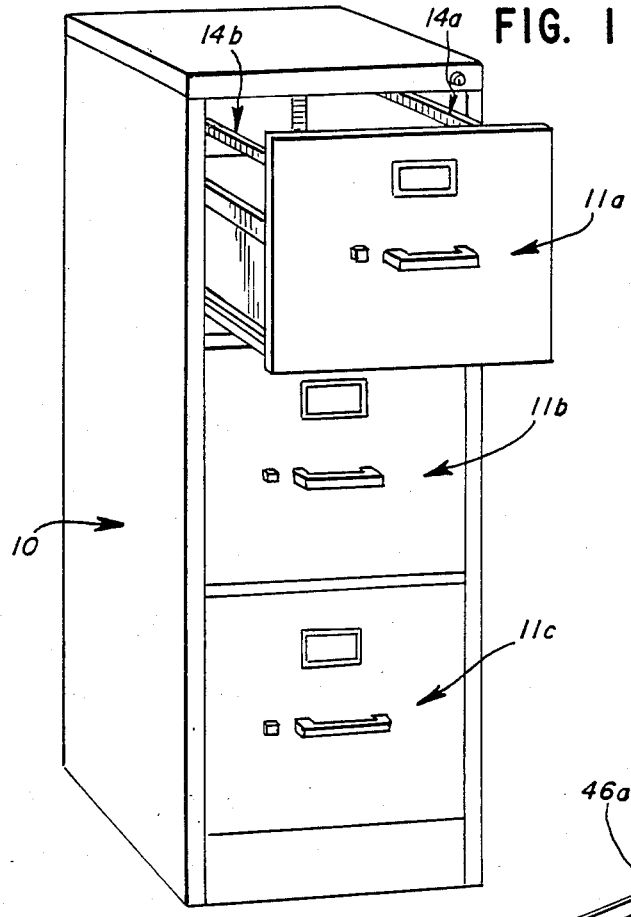
FIG. 1
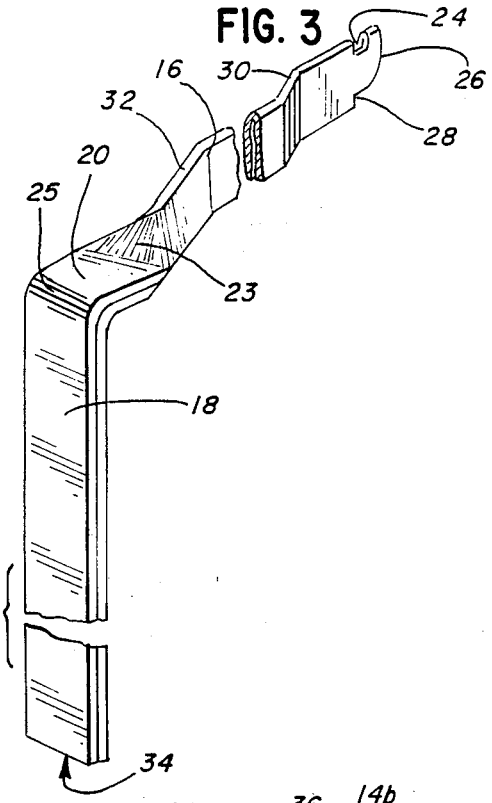
FIG. 3
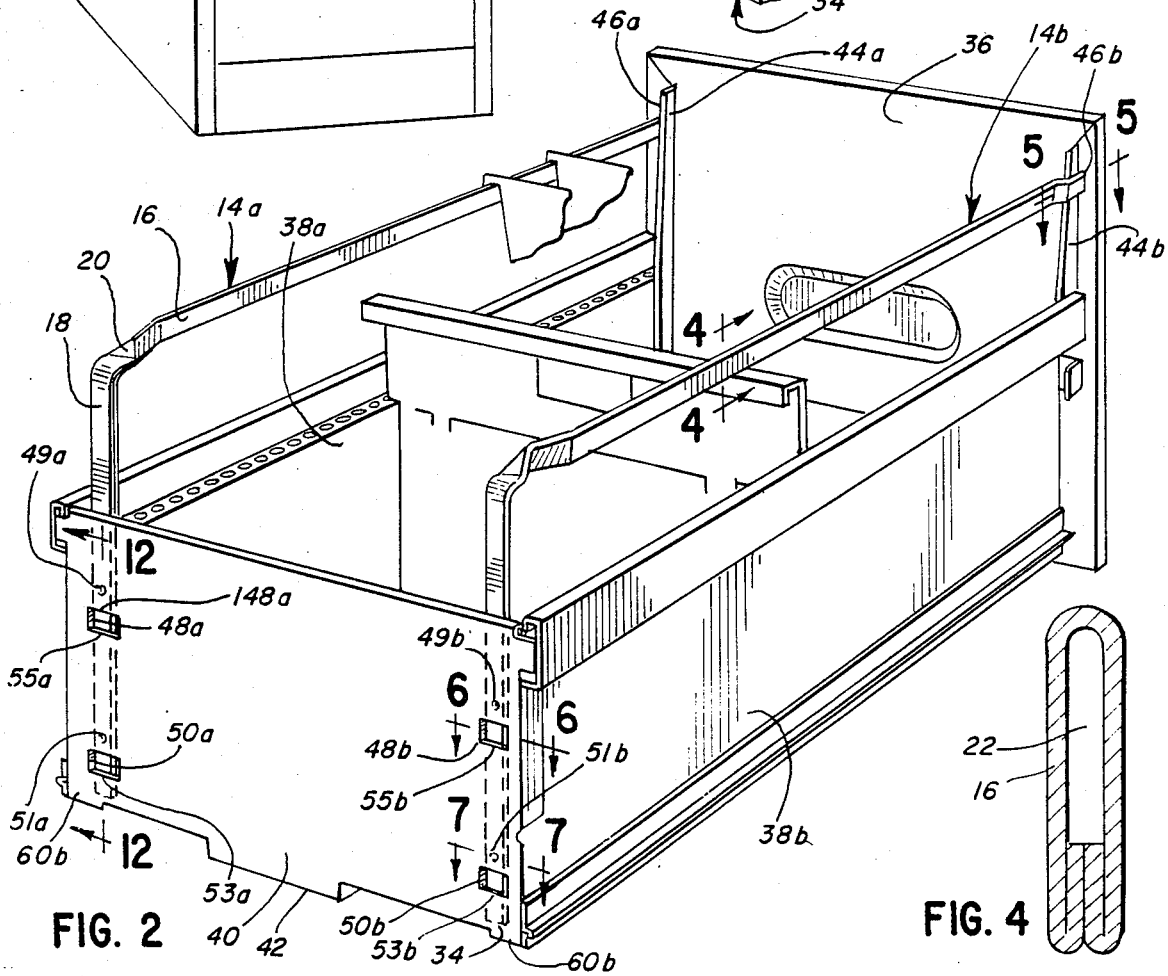
FIG. 2
FIG. 4

FIG. 5
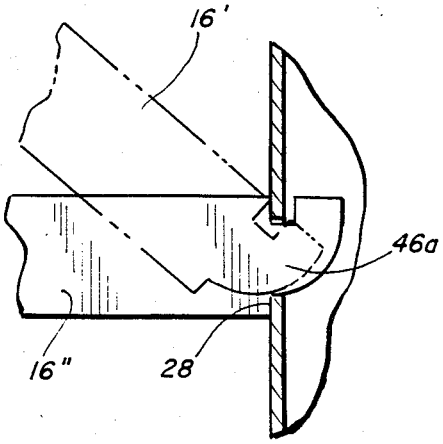
FIG. 6
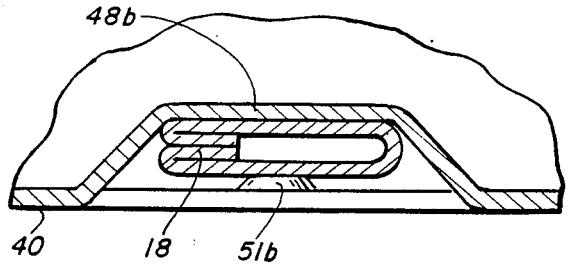
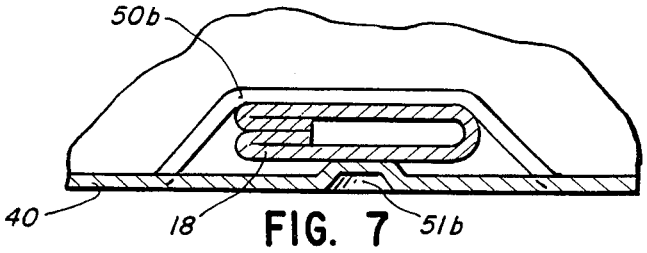
FIG. 7
FIG. 8
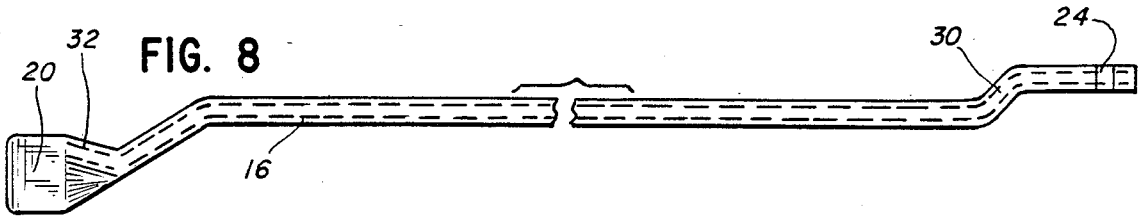
FIG. 9
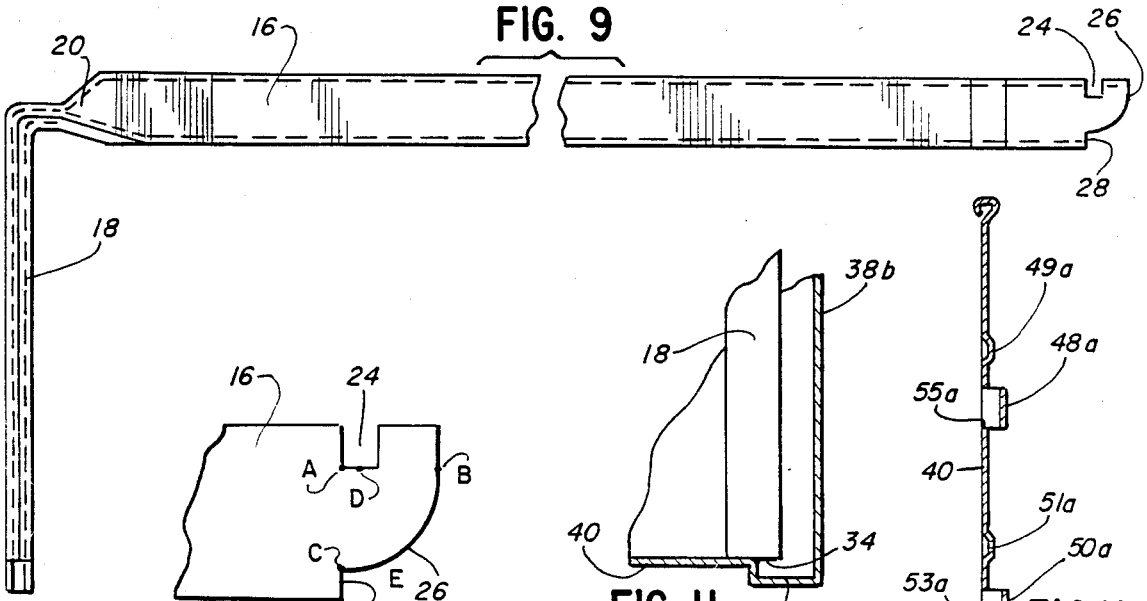
FIG. 10
FIG. 11
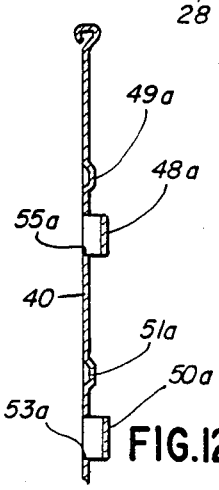
FIG.12

FILE SYSTEM WITH HANG RAIL

This application is a continuation of application Ser. No. 108,785 filed Oct. 15, 1987 now abandoned.

BACKGROUND OF THE INVENTION

This invention relates generally to filing systems and more particularly to the provision of removable support rails in file drawers to accommodate hanging or suspended files.

A suspended file is a file which hangs within a receptacle such as a desk drawer or cabinet drawer. A suspended file typically includes a file folder with a bar secured to each top edge of the file such that the file may be vertically disposed within an open top receptacle such as a desk or cabinet drawer in a suspended manner by resting the terminal portions of the file bar upon the top edges of a supporting means. A large percentage of cabinet and desk purchasers use such suspended files.

In some instances, manufacturers produce cabinets and desk drawers with side walls having a vertical height substantially equal to the vertical height of the drawer opening In these circumstances, a file may be suspended by resting the terminal portions of the file bar directly upon the top edges of the drawer sidewall.

However, in many instances, manufacturers produce cabinet and desk drawers with sidewalls having a vertical height substantially less than the vertical height of the drawer opening. Such drawers are desirable because there is a lower cost associated with drawers having lower sidewalls. Of course, a drawer with a low sidewall cannot by itself support a suspended file. Thus, manufacturers have developed various types of support devices which are attachable to drawers with low sidewalls so that customers have the option to use suspended files.

Such support devices require longitudinal, vertical and rotational stability to support the hanging files. To achieve the required stability, manufacturers have developed multi-component support devices comprising several bars and interconnecting members. Installation of such devices normally takes upwards to 5 minutes or more time and requires the use of auxiliary hardware. Other manufacturers have developed support means which do not require auxiliary hardware to install, but which have large cumbersome bodies with complicated designs including multiple flanges, tabs, and saddles.

OBJECTS OF THE INVENTION

Accordingly, it is the object of the present invention to provide an improved file system including a pair of hang rails adapted to be quickly attached to a drawer without the use of any auxiliary equipment.

It is another object of this invention to provide a pair of support hang rails which are each low-cost unitary elements of simplified design having a strength adequate to support hanging files.

Another object of the present invention is to provide an improved filing device with specially adapted drawers which provide stability to the hang rails of this invention.

In particular, it is an object of this invention to provide drawers capable of accommodating the front portion of a hang rail which has a unique camming surface for installation. The drawers provide vertical support as well as longitudinal and rotational stability to the hang rails.

These and yet additional objects and features of this invention will become apparent from the following discussion of the preferred embodiment, and from the attached drawings and appended claims.

SUMMARY OF THE INVENTION

These objects are achieved by an improved file system which comprises a drawer with a pair of attachable hang rails. Each hang rail is a unitary element which includes a horizontal bar having a front end and a back end and a vertical support post having a top end and a bottom end. The front end of the horizontal bar has a rounded camming surface extending from the lower side of the front end to the upper side of the front end. The camming surface is substantially in the shape of a segment of an ellipse. The front end also includes a notch adjacent to the upper side of the camming surface. The back end of the horizontal bar is connected to the top end of the vertical post by means of a connecting bend in the hang rail. The horizontal bar and vertical support post are substantially perpendicular to one another.

The file drawer includes a front wall, a back wall, two sidewalls and a drawer bottom. The inside of the back wall has two bracing sleeves adjacent to each sidewall for accommodating the vertical posts of the hang rails. The back wall further includes a dimple protruding towards the front wall located above each bracing sleeve. The inside of the front wall of the drawer has an elongated rectangular slot adjacent to the plane of each sidewall for accommodating the front end of the hang rail.

Each hang rail is attached to the drawer by inserting the front end of the horizontal bar into the rectangular slot on the front wall. The hang rail is inserted on an inclined angle such that the back end of the horizontal bar is elevated relative to the height of the slot on the front wall. The hang rail is then rotated downward such that the horizontal bar becomes perpendicular to the plane of the front wall. As the hang rail is rotated downward, the rounded camming surface of the front end acts with the bottom edge of the slot to cause a portion of the notch on the front end to move upward and straddle the material forming the upper edge of the slot. By straddling the upper edge of the slot, the notch provides a positive lock against removal from the slot. The slot provides vertical support because the lower side of the front end of the horizontal bar rests upon the bottom edge of the slot. The side edges of the slot provide further stability by restricting the transverse movement of the horizontal bar and also prevent rotational movement of the horizontal bar.

As the hang rail is rotated downward in the slot, the vertical post of the hang rail is flexed inward towards the front wall of the drawer to provide clearance for the post to be inserted into the two bracing sleeves on the inside of the back wall. Each sleeve braces the vertical post and accommodates lateral tipping loads on the post. At least a portion of the horizontal surface of the bottom end of the post rests on the drawer bottom, thus providing vertical support. By bracing the post on the inside of the drawer, the hang rail is captured between the inside of the front wall and the inside back wall of the drawer, thereby providing further longitudinal stability.

The hang rail of the present invention can be installed easily within a very short time, e.g., thirty seconds, without the use of any auxiliary hardware. The rail can be manufactured with inexpensive pre-coated roll-formed steel which is formed to produce a rail with adequate strength and lower cost.

DESCRIPTION

For more complete understanding of the invention, reference should be made to the drawings wherein:

FIG. 1 is a perspective front view of one embodiment of the improved file system with hang rails.

FIG. 2 is a perspective back view of the drawer shown in FIG. 1 with the pair of hang rails attached thereto.

FIG. 3 is an enlarged, perspective view of a hang rail shown in FIG. 2.

FIG. 4 is a cross-sectional view of the hang rail taken along line 4—4 in FIG. 2.

FIG. 5 is an enlarged, fragmentary view of the front end of the hang rail and the front inside wall of the drawer taken along line 5—5 in FIG. 2.

FIG. 6 sectional view of the vertical post of the hang rail and the bracing sleeve on the inside back wall of the drawer taken along line 6—6 of FIG. 2.

FIG. 7 is a sectional view of the vertical post of the hang rail and the dimple on the inside back wall of the drawer line 7—7 of FIG. 2.

FIG. 8 is a top view of a hang rail of FIG. 2.

FIG. 9 side view of a hang rail of FIG. 2.

FIG. 10 is an enlarged view of the front end of the horizontal bar of each of the hang rails.

FIG. 11 is an enlarged, fragmentary view showing the vertical post of the hang rail resting on the drawer bottom.

FIG. 12 a sectional view of the back wall of the drawer taken line 12—12 of FIG. 2.

Figure 13:
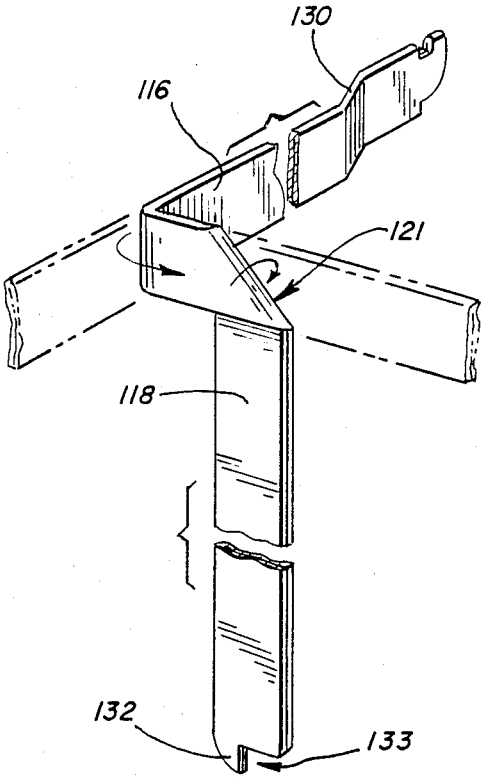

FIG. 13 is an enlarged perspective view of an alternative embodiment of the hang rail of this invention.

Figure 14:
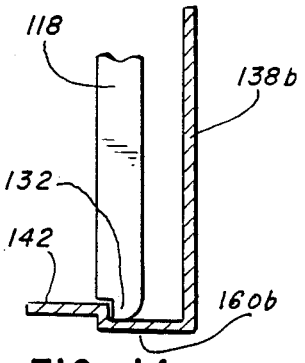

FIG. 14 is an enlarged fragmentary view showing the vertical post of the hang rail of FIG. 13 resting on the drawer bottom.

Referring to FIG. 1, one embodiment of the improved filing system of the present invention comprises a file cabinet 10 with three drawers 11*a*, 11*b*, 11*c*. The top drawer 11*a* is shown in the open position with two hang rails 14*a*, 14*b*.

Turning to FIG. 2, the top drawer 11*a* and two hang rails 14*a*, 14*b* are shown in greater detail. The two hang rails of a pair are mirror images of one another and otherwise are identical. Hence only one will be described in detail.

The hang rail 14*a* is a unitary element which comprises a horizontal hanger bar 16, a vertical support post 18 and a connector segment 20 therebetween. As shown in FIGS. 2 and 4, the hang rail 14*a* is substantially elongate in cross section. The rail is roll-formed of pre-coated sheet metal stock. The rail defines a hollow channel 22 which is produced by folding the pre-painted steel. The folded rail has adequate strength to support hanging files; however the material cost for the folded rail is lower than solid bars of heavier weight.

The length of the horizontal bar 16 is approximately equal to the length of the sidewall 38*a* of the drawer 11*a*. As shown in FIGS. 3 and 9, the front end of the horizontal bar 16 includes a notch 24, a curvilinear camming surface 26 and a lip 28. The notch 24 is located on the upper side of the horizontal bar 16 and is adjacent to the upper edge of the camming surface 26.

The camming surface 26 is designed to provide a positive lock against movement once the hang rail is attached to the drawer. As shown in FIG. 10, the dimensions of the front camming surface are such that the distance from point A, which is located at the rear lower corner of notch 24, to point B, which is located on the upper side of camming surface 26, is less than or approximately equal to the distance from point A to point C, which is located on the lower side of camming surface 26. Consequently, the distance from point D, which is located in the middle of the notch 24, to point B is always less than the distance from point D to point E, which is located on the lower side of the camming surface 26. Thus, the points along the camming surface form an elliptic shape relative to point D. As will be discussed in further detail below, the resulting elliptic rotation about point D provides a positive lock against longitudinal movement of the horizontal bar.

As shown in FIGS. 3 and 8, the horizontal bar 16 includes an offset bend 30 near the front of the horizontal rail 16. The horizontal bar 16 includes a second offset bend 32 near the back of the horizontal bar. These lateral offset bends are not essential for the invention, but rather only necessary for this particular embodiment to situate the rail around the flange 44*a* and obtain proper spacing between the hang rails to accommodate the hanging files.

The horizontal bar 16 is attached to the vertical post 18 by the connector segment 20. In the preferred embodiments, the hang rail 14*a* is a unitary element with the horizontal bar 16, the vertical post 18 and the connector segment 20 formed by bending and cutting a straight rail. Both the connector segment and the vertical post are resilient and relatively flexible in the plane of the hang rail.

In the embodiment as shown in FIGS. 3, 8 and 9, a connector segment 20 is produced by first rotating one portion of a straight rail 90° while clamping the other portion firm, thereby forming a 90° twist, as at 23 in FIG. 3. The twisted rail is then bent 90° at a point adjacent to the twisted point, as at 25 in FIG. 3, thereby defining the vertical post 18 and the horizontal bar 16. The horizontal bar 16 thereby is oriented with its elongated cross-section in a vertical plane for maximum support beam strength while the post 18 has its elongate cross-section horizontally disposed parallel to the back wall of the drawer. The connector segment 20 is formed between the top of the vertical post 18 and includes the twisted section of the horizontal bar 16. The rail is bent to form the offset bends 30, 32.

In another embodiment as shown in FIG. 13, a connector segment 120 is produced by bending a straight rail at a 90° angle. The rail also is bent or folded along about a 45° angle to form a beveled edge 121, thereby forming the connector 120 with the resulting vertical post 118 having its longitudinal axis perpendicular to the resulting horizontal bar 116. The vertical post 118 has its major plane parallel to the back wall when the major plane of the horizontal bar is vertical (as shown in FIG. 13).

Turning back to FIGS. 2 and 3, the vertical post 18 is substantially elongate in cross-section. The height of the vertical post 18 is sufficient to support the horizontal bar 16 such that a hanging file of appropriate depth can be freely suspended.

Referring to FIG. 2, the cabinet drawer 11*a* includes a front wall 36, two side walls 38*a*, 38*b*, a back wall 40, and a drawer bottom 42. The front wall includes two flanges 44*a*, 44*b* which are adjacent to the sidewalls 38*a*, 38*b*, respectively. The front wall further includes two slots 46*a*, 46*b* which are located at a height above the bottom 42 approximately equal to the height of the vertical post 18 and which are adjacent to the planes of the sidewalls 38*a*, 38*b*, respectively. As shown in FIGS. 2 and 5, the slots 46*a*, 46*b* are used to accommodate the front ends of the horizontal bar 16. As discussed below, the slot provides stability and vertical support for the rail.

The inside of the back wall 40 of drawer 11*a* includes a pair of upper bracing sleeves 48*a*, 48*b* and a pair of lower bracing sleeves 50*a*, 50*b*. The upper bracing sleeve 48*a* is located at the same height on the back wall 40 as the upper bracing sleeve 48*b*. Similarly, the lower bracing sleeve 50*a* is located at the same height on the back wall 40 as the lower bracing sleeve 50*b*. The line formed between the upper bracing sleeve 48*a* and the lower bracing sleeve 50*a* is perpendicular to the plane of the drawer bottom 42. Similarly, the line formed between the upper bracing sleeve 48*b* and the lower bracing sleeve 50*b* is perpendicular to the plane of the drawer bottom 42. The bracing sleeves engage the respective vertical post 18 to provide stability as will be discussed below.

As shown in FIGS. 2, 6 and 12, the upper bracing sleeve 48*b* is formed by cutting two parallel vertical lines on the back wall 40. The material between the vertical lines is then struck outward towards the front wall to create a gap between the struck-out material and the plane of the back wall. The gap is large enough to accommodate the vertical post 18. The other bracing sleeves 48*b*, 50*a*, 50*b* are formed by the same method. The method of forming the sleeves and their particular shape are not essential to the invention. For example, a sleeve may be formed by cutting the back wall to form two struck-out tabs, one of which is L-shaped in cross-section. The sleeve may alternatively be formed by a substantially C-shaped or U-shaped piece is welded or otherwise attached to the back wall.

The back wall includes a pair of upper dimples 49*a*, 49*b* and a pair of lower dimples 51*a*, 51*b*. With each dimple protrudes towards the front wall 36 of the drawer. The upper dimples 49*a*, 49*b* are located adjacent to and directly above the upper bracing sleeves 48*a*, 48*b*, respectively. The lower dimples 51*a*, 51*b* are located adjacent to and directly above the lower bracing sleeves 50*a*, 50*b*, respectively. As shown in FIGS. 2, 7 and 12, the lower dimples 51*a*, 51*b* each guide the vertical posts away from the surface of the back wall 40, thereby preventing the horizontal surface 34 at the bottom of the vertical posts from snagging on the cut-out lips 53*a*, 53*b*. The upper dimples 49*a*, 49*b* prevent the bottom of the vertical post from snagging on cut-out lips 55*a*, 55*b*, respectively.

The bottom 42 of the drawer has two longitudinal channels 60*a*, 60*b* which run in a direction generally parallel to the plane of the side walls 38*a*, 38*b*. The channels 60*a*, 60*b* are adjacent to side walls 38*a*, 38*b*, respectively. As shown in FIG. 11, the horizontal surface 34 at the bottom of vertical post 18 rests on the drawer bottom 42. Because of the location of the channel 60*b*, the horizontal surface 34 only partially rests on the drawer bottom 42, which is adequate to support the hang rail. However, this feature is not essential for the invention, but rather only caused by the location the channels 60*a*, 60*b* of this embodiment. The horizontal surface 34 can rest entirely on a drawer bottom having a flat surface with or without channels.

In another embodiment as shown in FIGS. 13 and 14, the bottom end 132 of a vertical post 118 includes a rectangular indentation 133 for the purpose of providing further stability when the hang rail is attached to a cabinet drawer having channels. As shown in FIG. 14, the channel 160*b* and bottom 142 both provide vertical support for the hang rail. The vertical edge of the rectangular indentation 133 at the bottom end 132 of the post 118 rests against the edge formed by the side of the channel 160*b* and the drawer bottom 142. This arrangement provides further rotational stability to the hang rail.

One may install the hang rails into the drawer in less than 30 seconds. Referring to FIG. 5, the front end of the horizontal bar 16 is inserted into slot 46*a* on an inclined angle as shown at position 16'. Referring back to FIG. 10, the distance between point D and point B is substantially less than the length of the opening of slot 46*a*. Thus, the inclined front end of the horizontal bar 16 fits into the slot 46*a*. The hang rail is then rotated downward until the horizontal bar 16 is normal to the plane of the front drawer as shown in FIG. 5 at position 16". As the hang rail is rotated downward, the front camming surface 26 of the horizontal bar 16 acts with the bottom edge of the slot to cause a portion of the notch 24 to move upward and straddle the material forming the upper edge in the slot 46*a*. As shown in FIGS. 5 and 10, the distance from point D to the edge of the camming surface 26 increases from point B to point E, thereby causing the gap between the slot 46*a* and the bottom edge of notch 24 to begin to close as the bar is rotated downward. The distance between point D and point E as shown in FIG. 10 approaches the length of the opening of the slot 46*a*. Thus, the notch 24 is forced upward and straddles the upper edge of the slot 46*a*. By straddling the upper edge of the slot, the notch 24 provides a positive lock against unintentional removal of the bar 16 from the slot 46*a*.

The lip 28 rests against the front wall 36 of the drawer to prevent the horizontal bar 16 from extending further into the slot 46*a*. Thus, the lip 28 provides longitudinal stability. The lower side of the camming surface 26 rests against the bottom edge of slot 46*a*, thereby providing vertical support for the horizontal rail 16. The side edges of the slot provide further stability by restricting transverse movement of the horizontal bar 16 and also prevent rotation of the horizontal bar 16.

As the hang rail is rotated downward from position 16' to position 16" as shown in FIG. 5, the vertical post 18 is flexed inward towards the front wall 36 of the drawer. The flexing provides clearance for the post 18 to be inserted into the upper bracing sleeve 48*a* and the lower bracing sleeve 50*a*. The sleeves provide rotational stability to the hang rail.

As shown in FIG. 2, the hang rail is wedged between the inside of the front wall 36 and the inside of the back wall 40. By capturing the hang rail between the inside of the walls, the hang rail is provided with further longitudinal stability.

Thus, applicants have provided an improved file system with hang rails for suspending hanging files. The hang rail of the present invention is an unitary element and has a simplified design. Yet, the hang rail has adequate longitudinal and rotational stability and vertical support. Moreover, one can quickly install the hang rail without the use of any auxiliary hardware.

What is claimed is:

1. A hanging file support device for insertion into a drawer having a front wall with a slot and a back wall with supporting means, said device comprising a horizontal bar having a front end and a back end, said front end having a two-sided notch disposed on the upper side of said front end, said two-sided notch having a bottom between the sides; a vertical post at the back end of said horizontal bar; and interconnecting means between said vertical post and said horizontal bar; wherein said front end of said horizontal bar further includes a camming surface, said camming surface being of a configuration and dimensions to permit inspection of the front end of the horizontal bar into the slot of said front wall when the horizontal bar is at an inclined angle, and to cause the notch to straddle said front wall at the upper edge of said slot when the horizontal bar is in a horizontal position by engagement of said camming surface with the lower edge of said slot.

2. A hanging file support device as in claim 1 wherein said notch has a bottom edge with a center point, and said camming surface includes a first point adjacent to the upper side of said front end and a second point adjacent to the lower side of said front end, and wherein the distance from said first point to said center point is less than the distance from said second point to said center point.

3. A hanging file support device as in claim 2 wherein the area defined by the straight line running from said center point to the first point, the edge of the front camming surface between said first point and second point, and the straight line running from the second point to said center point forms a substantially elliptically-shaped wedge.

4. The hanging file support device as in claim 1 wherein the horizontal bar is substantially elongate in cross-section.

5. A file system capable of storing hanging files comprising:

a drawer having a front wall with a slot and a back wall with supporting means, and a hanging file support device for insertion into said drawer, said device comprising a horizontal bar having a front end and a back end, said front end having a two-sided notch disposed on the upper side of said front end, said two-sided notch having a bottom between the sides; a vertical post at the back end of said horizontal bar; and interconnecting means between said vertical post and said horizontal bar; wherein said front end of said horizontal bar further includes a camming surface, said camming surface being of a configuration and dimensions to permit insertion of the front end of the horizontal bar into the slot of said front wall of said drawer when said horizontal bar is at an inclined angle, and to cause the notch to straddle said front wall at the upper edge of said slot when the horizontal bar is in a horizontal position by engagement of said camming surface with the lower edge of said slot.

* * * * *

UNITED STATES PATENT AND TRADEMARK OFFICE

CERTIFICATE OF CORRECTION

PATENT NO. : 4,887,873

DATED : December 19, 1989

INVENTOR(S) : James Goedken, et al

It is certified that error appears in the above-identified patent and that said Letters Patent is hereby corrected as shown below:

| | |
|---|---|
| Col. 3, Line 23 | After "FIG. 6" insert --is a---. |
| Col. 3, Line 28 | After "drawer" insert --taken along--. |
| Col. 3, Line 31 | After "FIG. 9" insert --is a--. |
| Col. 3, Line 37 | After "taken" insert --along--. |
| Col. 7, Line 15 | Delete "inspection" and insert therefor --insertion--. |

Signed and Sealed this

Fourth Day of December, 1990

*Attest:*

HARRY F. MANBECK, JR.

*Attesting Officer*

*Commissioner of Patents and Trademarks*